US007963139B2

(12) United States Patent
Shortridge et al.

(10) Patent No.: US 7,963,139 B2
(45) Date of Patent: Jun. 21, 2011

(54) APPARATUS FOR CAN EXPANSION

(75) Inventors: Jeffrey L. Shortridge, Lynchburg, VA (US); Dennis Shuey, Forest, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 624 days.

(21) Appl. No.: 11/643,935

(22) Filed: Dec. 22, 2006

(65) Prior Publication Data

US 2008/0282758 A1 Nov. 20, 2008

Related U.S. Application Data

(60) Provisional application No. 60/787,502, filed on Mar. 31, 2006.

(51) Int. Cl.
*B21D 51/26* (2006.01)
*B21D 3/02* (2006.01)
*B21J 11/00* (2006.01)

(52) U.S. Cl. ..... 72/94; 72/117; 72/405.03

(58) Field of Classification Search ..... 72/80, 94, 72/370.06–370.08, 379.4, 405.03, 124, 125, 72/115, 117, 118, 370.01, 370.1, 354.6; 413/23, 413/50, 69

See application file for complete search history.

(56) References Cited

U.S. PATENT DOCUMENTS

| | | | | |
|---|---|---|---|---|
| 1,621,301 | A | | 1/1927 | Wright |
| 2,346,376 | A | * | 4/1944 | Heavener ..... 72/125 |
| 2,686,551 | A | | 8/1954 | Laxo |
| 2,928,454 | A | | 3/1960 | Laxo |
| 3,096,709 | A | | 7/1963 | Eldred et al. |
| 3,621,530 | A | | 11/1971 | Pflieger et al. |
| 3,983,729 | A | | 10/1976 | Traczyk et al. |
| 4,030,432 | A | | 6/1977 | Miller et al. |
| 4,102,168 | A | * | 7/1978 | Brookes et al. ..... 72/117 |
| 4,207,761 | A | * | 6/1980 | Niemi ..... 72/354.2 |
| 4,513,595 | A | | 4/1985 | Cvacho |
| 4,697,691 | A | | 10/1987 | Zodrow et al. |
| 4,892,184 | A | | 1/1990 | Vander et al. |
| 5,704,240 | A | | 1/1998 | Jordan |
| 5,762,174 | A | | 6/1998 | Risley et al. |
| 6,050,396 | A | | 4/2000 | Moore |
| 6,055,836 | A | | 5/2000 | Waterworth et al. |
| 6,176,006 | B1 | | 1/2001 | Milliman et al. |
| 6,199,420 | B1 | | 3/2001 | Bartosch |

(Continued)

FOREIGN PATENT DOCUMENTS

CA 2 536 841 3/2005

(Continued)

OTHER PUBLICATIONS

U.S. Appl. No. 11/581,787, filed Oct. 17, 2006, Marshall.

(Continued)

*Primary Examiner* — Teresa M Ekiert
(74) *Attorney, Agent, or Firm* — Foley & Lardner LLP

(57) ABSTRACT

An apparatus to expand a diameter of a can or other article comprises a forming turret that includes a stop plate and a forming tooling. The stop plate is configured to be adjacent a dome-end of a can to restrict motion of the can; the stop plate is axially movable relative to a turret axis of rotation. The forming tooling includes a plate and an expansion tool axially movable relative to the turret axis of rotation. The plate includes an opening through which the tool passes. The expansion tool is configured to move into an open end of the can to expand the diameter of the can.

13 Claims, 7 Drawing Sheets

U.S. PATENT DOCUMENTS

| | | | |
|---|---|---|---|
| 6,378,695 | B1 | 4/2002 | Rinne |
| 6,467,322 | B2 | 10/2002 | Nogami et al. |
| 6,644,083 | B2 | 11/2003 | Pakker |
| 6,672,122 | B2 | 1/2004 | Mustread et al. |
| 6,779,651 | B1 | 8/2004 | Linglet et al. |
| 2005/0193796 | A1 | 9/2005 | Heiberger et al. |
| 2007/0017089 | A1 | 1/2007 | Hosoi |

FOREIGN PATENT DOCUMENTS

| | | |
|---|---|---|
| DE | 1 939 623 | 2/1970 |
| DE | 101 56 085 | 5/2003 |
| FR | 2 881 123 | 7/2006 |
| GB | 07306 | 3/1898 |
| JP | 2002-102968 | 4/2002 |
| JP | 2003-237752 | 8/2003 |
| JP | 2003-251424 | 9/2003 |
| JP | 2003-252321 | 9/2003 |
| JP | 2003-320432 | 11/2003 |
| JP | 2004-002557 | 1/2004 |
| JP | 2004-130386 | 4/2004 |
| JP | 2004-160468 | 6/2004 |
| JP | 2004-217305 | 8/2004 |
| JP | 2005/022663 | 1/2005 |
| JP | 2006-176140 | 7/2006 |
| JP | 2006-176183 | 7/2006 |
| WO | WO-94/12412 | 6/1994 |
| WO | WO-96/33032 | 10/1996 |
| WO | WO-97/37786 | 10/1997 |
| WO | WO-97/49509 | 12/1997 |
| WO | WO-2006/067901 | 6/2006 |

OTHER PUBLICATIONS

U.S. Appl. No. 11/643,934, filed Dec. 22, 2006, Shortridge.
U.S. Appl. No. 11/643,950, filed Dec. 22, 2006, Marshall et al.
U.S. Appl. No. 11/692,564, filed Mar. 28, 2007, Marshall et al.
U.S. Appl. No. 11/692,584, filed Mar. 28, 2007, Schill et al.
Applicants inform the PTO that an offer for sale was made more than one year before the date of this application of a device represented by the attached Figure ("Exhibit A"). Additional information is available upon request.
Office action dated Mar. 10, 2010 received in related U.S. Appl. No. 11/692,584.
USPTO Final Office Action dated Dec. 29, 2010 received in the related application of U.S. Appl. No. 11/581,787, filed Oct. 17, 2006 in the name of Harold James Marshall.

* cited by examiner

APPARATUS FOR CAN EXPANSION

CROSS-REFERENCE TO RELATED PATENT APPLICATIONS

This application claims the benefit under 35 U.S.C. §119 (e) of U.S. Provisional Application No. 60/787,502, filed Mar. 31, 2006, which is incorporated herein by reference in its entirety.

BACKGROUND

The present invention relates generally to the field of article expansion mechanisms. More specifically the invention relates to an apparatus and method of an article diameter.

Articles, such as bottles, cans and jar typically have safety seals applied thereto in order to prevent tampering and to alert customers of possible tampering. Safety seals, such as plastic collars and/or covers are generally attached to an article prior to shipping or delivering the article for a consumer. The safety seals require an article with a non-uniform sized neck in order to hold and retain the safety seal properly.

Conventionally, the non-uniform sized (diameter) neck can be produced when the article is initially shaped/formed, or the article may have an additional neck component added to retain the safety seal. Such conventional methods can be costly and time consuming.

SUMMARY

According to an embodiment of the invention, an apparatus to expand a diameter of an open end of an article is provided. The apparatus comprises: a forming turret that includes a forming tooling; and a stop plate. The stop plate is configured to be adjacent a closed end of an article to restrict motion of the article, the stop plate being axially movable relative to a turret axis of rotation. The forming tooling includes an expansion tool axially movable relative to the turret axis of rotation and a base plate. The base plate includes an opening through which the expansion tool passes, the expansion tool being configured to move into an open end of the article to expand the diameter of the article.

An embodiment of the invention provides a forming tooling apparatus. The forming tooling apparatus comprises: an expansion tool configured to expand the diameter of an article; and a base plate with an opening through which the expansion tool passes. The expansion tool includes a lead in portion, a pilot portion and a forming diameter portion.

According to an embodiment of the invention, a method of expanding the diameter of an open end of an article is provided. The method comprises: feeding an article into a turret; loading the article into a forming tooling station; inserting an expansion tool into an open end of the article; withdrawing the expansion tool; and transferring the article to another turret, discharge track or to another apparatus.

According to another embodiment of the invention, an apparatus to expand a diameter of an open end of an article is provided. The apparatus comprises: a forming turret that includes forming means; and stopping means to restrict motion of the article. The forming means includes expansion means to expand a diameter of the article, and a base plate with an opening.

According to yet another embodiment of the invention, a forming tooling apparatus. The forming tooling apparatus comprising: means for expanding a diameter of an article; and a base plate with an opening through which the expansion means passes. The expansion means includes a lead in means, a pilot means and a forming diameter means.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

FIG. 10(*a*) illustrates a can before expansion. FIG. 10(*b*) illustrates a can after expansion according to one embodiment in which the can has one expanded section. FIG. 10(*c*) illustrates a can after expansion and after a necking operation. FIG. 10(*d*) illustrates a can immediately after exiting a second expansion turret. FIG. 10(*e*) illustrates a can after the second expansion and a second set of subsequent necking operations.

FIG. 11(*a*) is a top, perspective view of a push ram assembly. FIG. 11(*b*) is a top, perspective view of a tooling ram assembly. FIG. 11(*c*) is a bottom, perspective view of the push ram assembly of FIG. 11(*a*). FIG. 11(*d*) is a bottom, perspective view of the ram assembly of FIG. 11(*b*).

DETAILED DESCRIPTION

Figure 1:
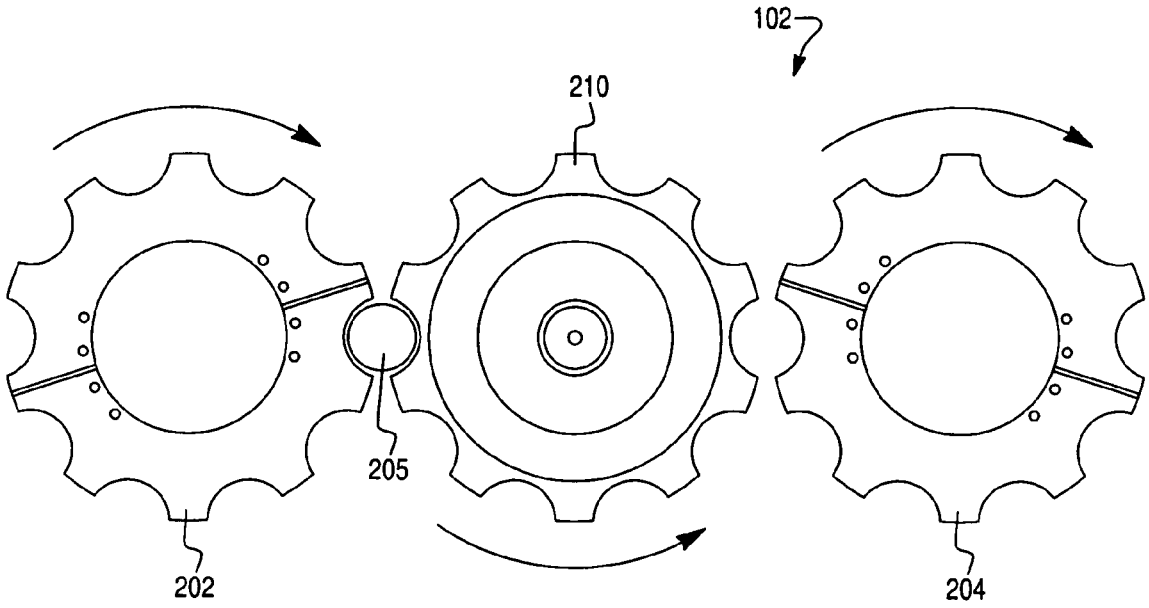
FIG. 1 is a schematic of a machine line with a can expansion apparatus according to an embodiment showing an infeed turret, a forming/process turret and a discharge or secondary turret.
Figure 2:
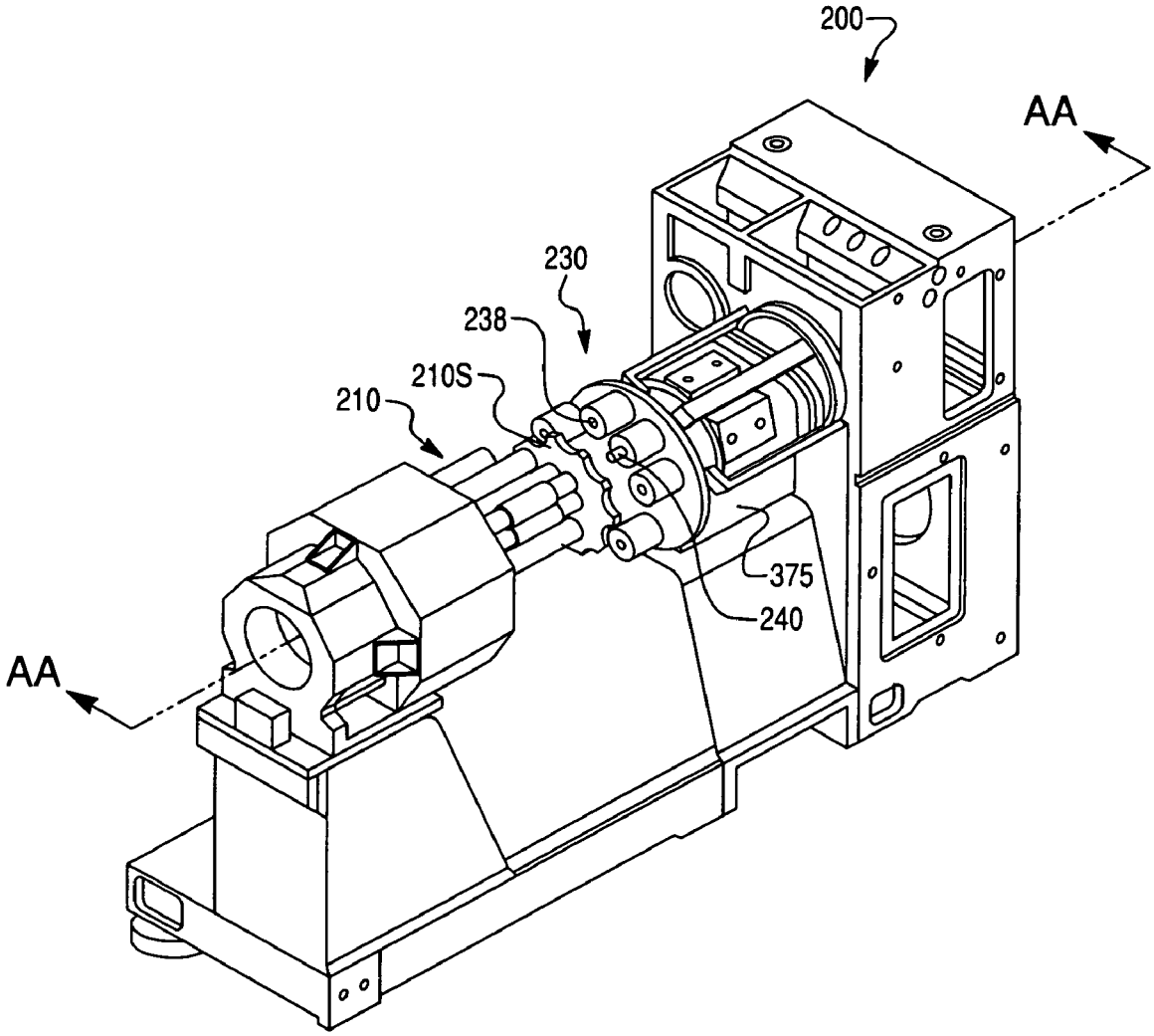
FIG. 2 is a perspective view of the can expanding apparatus of FIG. 1.
Figure 3:
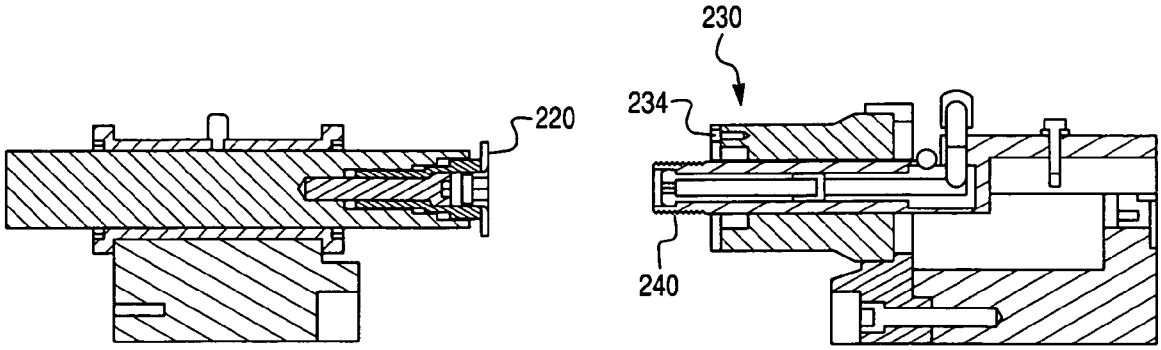
FIG. 3 is a cross-sectional view of the can expanding apparatus taken along line AA in FIG. 2.
Figure 4:
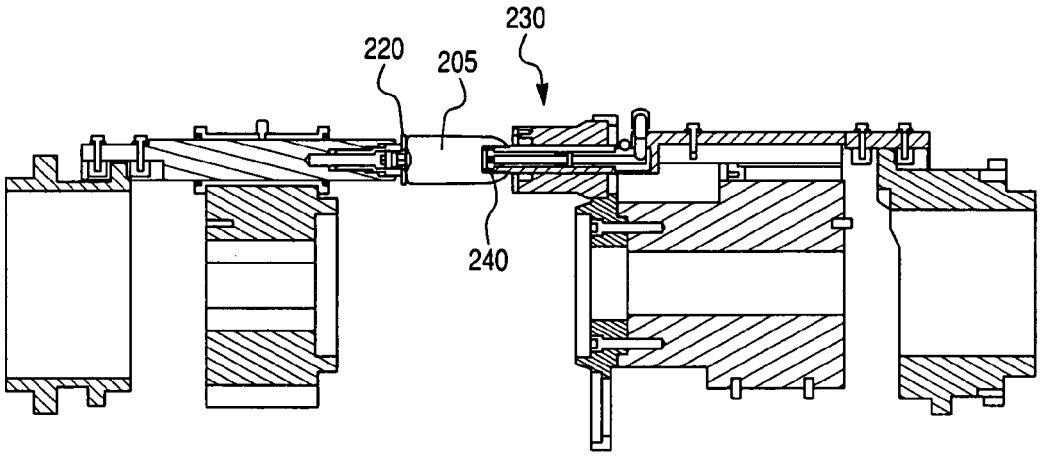
FIG. 4 is a cross-sectional view of the can expanding apparatus taken along line AA in FIG. 2 in which a can is shown.
Figure 5:
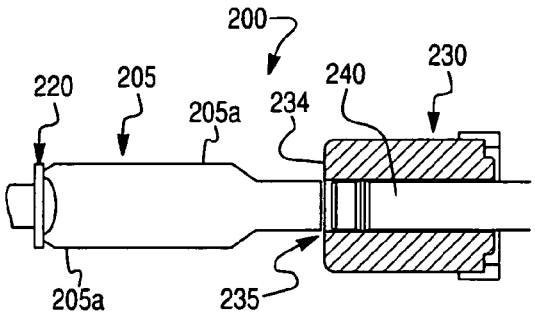
FIG. 5 is a side view of can expanding apparatus showing a can at loading.
Figure 6:
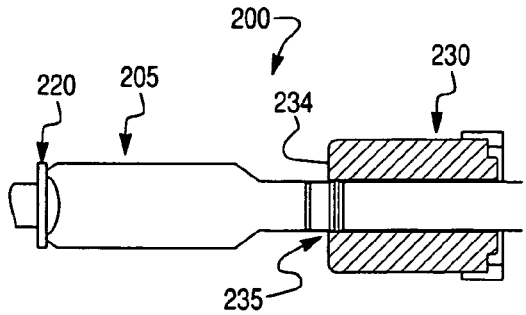
FIG. 6 is a side view of the can expanding apparatus of FIG. 5 showing the can with an expansion pilot engaged.
Figure 7:
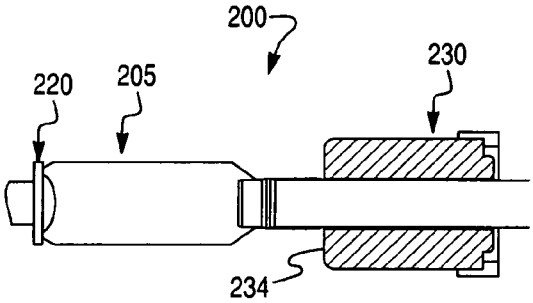
FIG. 7 is a side view of the can expanding apparatus of FIG. 5 showing the can with forming (expansion) tooling fully engaged.
Figure 8:
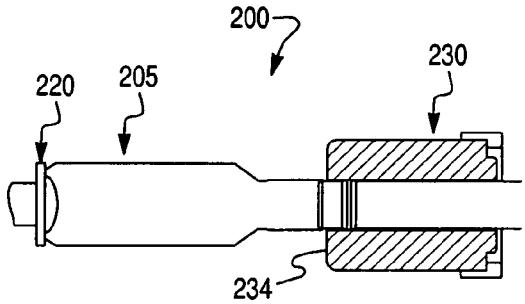
FIG. 8 is a side view of the can expanding apparatus of FIG. 5 showing the can with a stripping plate (mechanism) engaged.

An expansion mechanism may be a separate machine or the expansion mechanism may be one machine in a machine line. In a machine line, an article is first fed into a first machine to fill stations in a turret/star wheel. Each star wheel may have any number of stations to hold articles for processing or transfer. For example, a star wheel may have six, eight or ten stations to hold six, eight or ten articles, respectively. It will be recognized that the star wheel is capable of having one station to any suitable number of stations.

The article is then processed through any number of stages, one or more of which may be a diameter expansion stage. When all process/forming stages are complete, the article is discharged from the machine. The machine line may be a recirculated machine line or any other type of machine line.

An embodiment of the invention relates to an apparatus to expand a diameter of an article. The apparatus comprises a forming turret that includes a stop plate and a forming tooling. The stop plate is configured to be adjacent a closed (dome) end of a can to restrict motion of the can, the stop plate axially movable relative to the turret axis of rotation. The forming tooling including an expansion tool axially movable relative to the turret axis of rotation and a plate. The plate includes an opening through which the tool passes. The expansion tool is configured to move into an open end of the article to expand the diameter of the article.

The plate, according to an embodiment, may include a retaining ring to receive an open end of the article.

The apparatus, according to an embodiment, may further include a ram assembly with a cam and cam followers to move the expansion tool.

Another embodiment of the invention relates to a forming tooling apparatus. The forming tooling apparatus comprises an expansion tool configured to expand the diameter of an article and a stripping plate with an opening through which the expansion tool passes. The expansion tool includes a lead in portion, a pilot portion and a forming diameter portion. The forming diameter defines the diameter to which the article is expanded. The diameter of the pilot portion is approximately equal to the initial diameter of the article.

Articles, according to embodiments of the invention, may have an expanded diameter portion formed by an article expansion apparatus. The expanded diameter of the article may be utilized with pilfer proof rings, such as on beverage cans, or with other uses. A neck portion, or any other portion of an article, may be expanded in diameter.

Expansion of the diameter of metal articles may be accomplished in a similar fashion as necking.

An embodiment of the invention relates to a method of expanding an article diameter. The method comprises feeding an article into a continuously rotating turret, loading the article into a forming station, inserting an expanding tool into an open end of the article, withdrawing the expanding tool, and transferring the article to another turret, discharge track or to another apparatus. The diameter of the expanding tool is greater than the diameter of the open end of the article.

Embodiments of the invention will now be described with reference to the figures.

An article 205 may be a can, any suitable food or beverage container, jar, bottle or any other suitable article. The article 205 has an open end, opposite a closed end and a sidewall extending from the closed end. Alternatively, the article 205 may be open at both ends. A top, lid or other closure can be added to the article 205 after the expansion process.

For exemplary purposes only, the below description will describe the expansion machine for use on a can 205. It will be recognized that any other type of article 205 (such as that described above) may be used.

FIGS. 1 to 10(*c*) illustrate embodiments of a can expansion apparatus 200. Cans 205, according to an embodiment, are fed into a continuously rotating turret 210 either from an infeed track or from a preceding process turret 202, which may be part of a machine line 102. FIG. 1 illustrates an infeed turret star wheel 202 passing a can 205 to the continuously rotating turret star wheel 210 of the can expansion process. While the turret 210 is rotating with the can 205 loaded into a forming station therein, a forming tooling 230 (see FIGS. 2-8) with a diameter larger than the existing (initial) can diameter will be inserted into the can 205 and then withdrawn. The can 205 is then transferred from the expansion turret 210 onto another process turret 204 or a discharge track, in the direction illustrated by the arrows in FIG. 1.

The apparatus, according to an embodiment, comprises an infeed vacuum transfer wheel 202, the forming turret 210, and a discharge vacuum transfer wheel 204. Both the infeed and discharge vacuum transfer wheels 202, 204 are similar in design and function. The infeed wheel 202 loads the can 205 into the forming turret 210 and the discharge wheel 204 unloads the can 205 from the forming turret 210.

The cans 205 are held in position on this first transfer star wheel using a pneumatic pressure differential or "suction" as it will be referred to.

The cans are then passed from the first transfer star wheel to a first turret star wheel and enter into the can expansion forming process on the can expansion machine. While the invention is not so limited, embodiments of the invention may comprise expansion machines constructed as modules. The use of can expansion modules allows for the machine line 102 to be assembled/changed to provide as many can expansion stages as is required and to allow for the addition of additional stages such as flanging, necking, trimming, curling, threading, and/or base reforming/reprofiling, which may be added/removed as desired.

In an embodiment, the turret star wheels 202, 210, 204 may be composed of two segments, which are connected to a drive shaft by way of a timing plate. These timing plates are individually adjustable with respect to the respective turret drive shaft in a manner which allows their angular rotational position with respect to the turret drive shaft to be adjusted and then fixed to the degree that the two segments of the turret star wheel which are mounted thereon, are positioned/timed with respect to the transfer star wheels on either side thereof, so that a smooth, continuous, incident-free transfer of cans between the turret star wheels and the respective transfer star wheels, can take place.

As noted above, the transfer star wheels are arranged to hold the cans in position using suction. The star wheels may have a vacuum port formed in a channel portion(s) that are fluidly communicating with a source of vacuum (negative pneumatic pressure) via a suitable manifold. The vacuum is delivered to the vacuum ports, and the surface area of the cans which are exposed to the suction is increased to a degree that the cans are stably held in position as each can passes below the transfer star wheel axis of rotation.

The forming turret 210 comprises a stop plate 220 (see FIGS. 2-8) on the closed end (the domed end in some embodiments) of the can 205, positioning star wheels 210S at the straight wall 205*a* of the can 205, and the forming tooling 230 at the open end of the can 205. The stop plate 220 restricts the motion of the can 205 while the forming tooling 230 is being inserted into the can 205. The stop plate 220 works with the forming tooling 230 design to dictate the depth (or location along the length of the can 205) of the expanded diameter. The stop plate 220 can be made to move axially relative to the turret axis of rotation to facilitate loading of the can 205 onto the forming turret 210. The positioning star wheels 210S help keep the can 205 oriented and aligned with the forming tooling 230 to enable proper expansion (forming) of the article.

The forming tooling 230 comprises an expansion tool 240 and a stripping or base plate 234. The expansion tool 240 moves axially relative to the turret rotation axis into the can 205.

Figure 9:
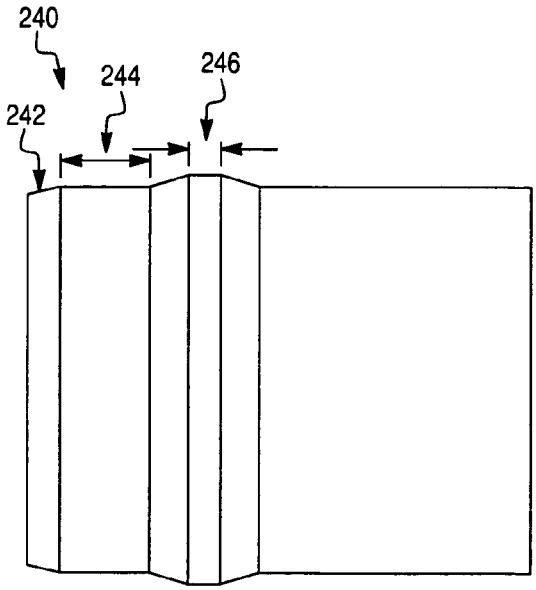
FIG. 9 is a side profile view of an expansion tool.

As shown in FIG. 9, the expansion tool 240 has a lead in feature 242 to facilitate insertion into the can 205. The expansion tool 240 has a pilot diameter 244 close (approximately equal) to the (initial) plug diameter of the can 205 coming into the expansion turret 210. The expansion tool 240 has a forming diameter 246, which will dictate the plug diameter of the can 205 after expansion of the article 205.

The base plate 234 is located at the open end of the can 205. The expansion tool 240 passes through an opening 235 in the base plate 234 as the expansion tool 240 is being inserted into the can 205. The opening 235 in the base plate 234 is configured by size and/or arrangement such that the expansion tool 240 will pass through the opening 235, but the expanded can 205 will not enter into the opening 235.

The base plate 234 in one embodiment ensures that the expansion tool 240 is withdrawn from the can 205. The turret 210 is continuously moving and, therefore, when the expansion tool 240 is removed, the location of the can 205 is such that the can 205 cannot pass through the opening 235. Rather, the can 205 continuously moves toward the point of being passed to the discharge turret. At the point the expansion tool 240 is fully retracted, the can 205 has been rotated by the turret 210 and is no longer aligned with the opening 235 in the base plate 234. Thus, if the can 205 is stuck or still attached to the expansion tool 240, the base plate 234 will "strip" the can 205 off the expansion tool 240 as the can 205 continues to rotate and the expansion tool 240 is retracted. The can 205 will then be passed, via vacuum, to the next star wheel.

In an embodiment, the stripping plate 234 is fixed and does not move. The stripping plate 234 is configured to remove the can 205 from the expansion tool 240 if the tool 240 does not completely withdraw from the can 205 because the can 205 cannot fit inside the opening 235 in the stripping plate 234. As the turret 210, and thus the can 205, rotates, the can 205 is released from the tool 240.

Figures 10A, 10B, 10C, 10D, 10E:
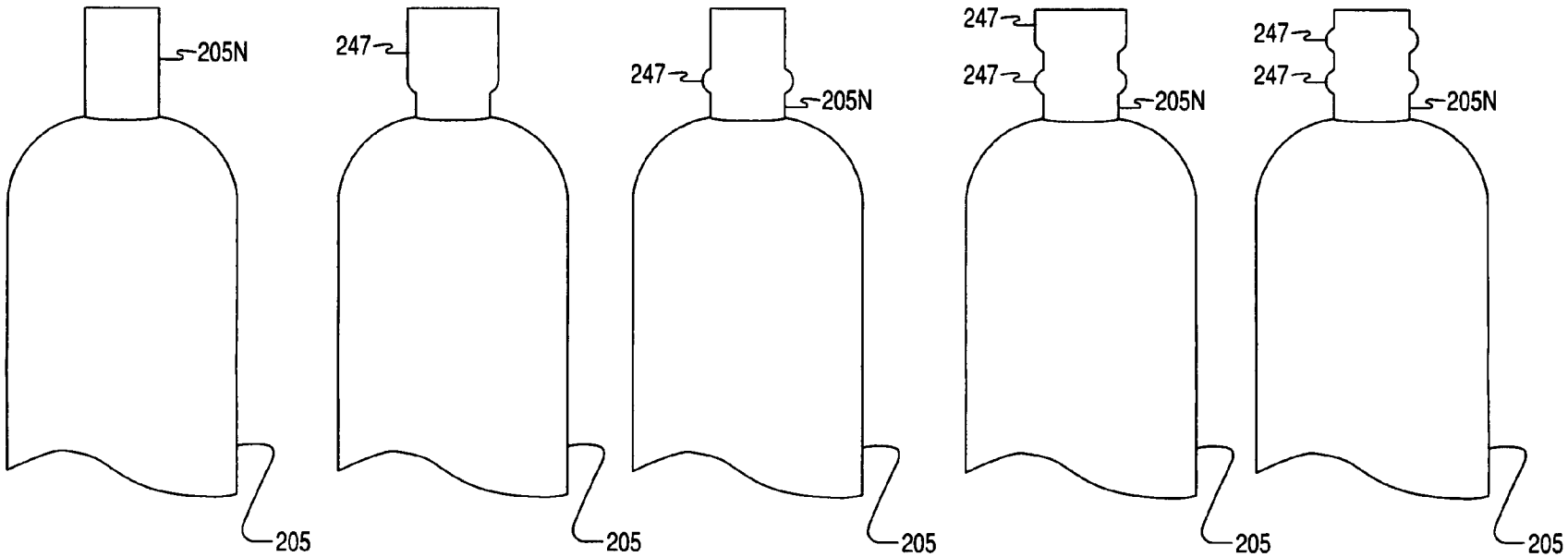
FIGS. 10(*a*), 10(*b*), 10(*c*), 10(*d*) and 10(*e*) are views of a can before and after expansion.
Figure 11B:
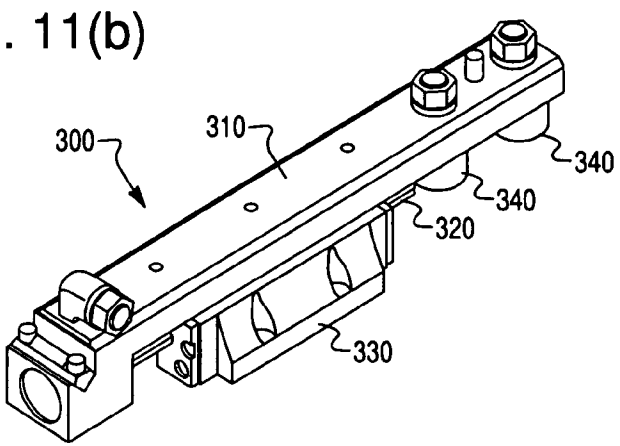
FIGS. 11(*a*) to 11(*d*) are views of a linear ram assembly.
Figure 11D:
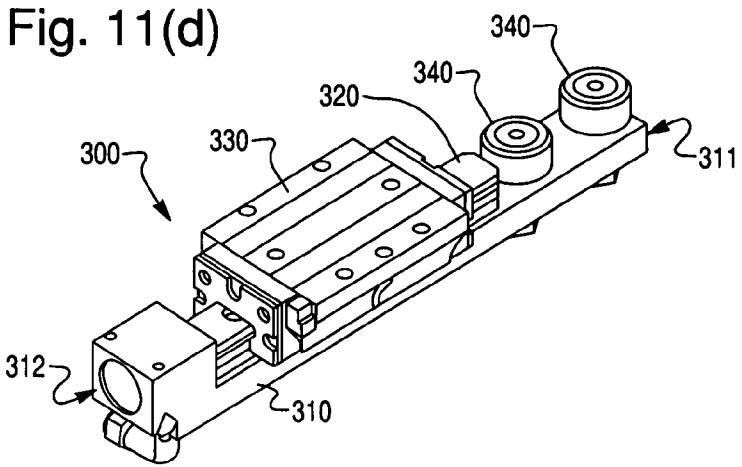
Figure 11A:
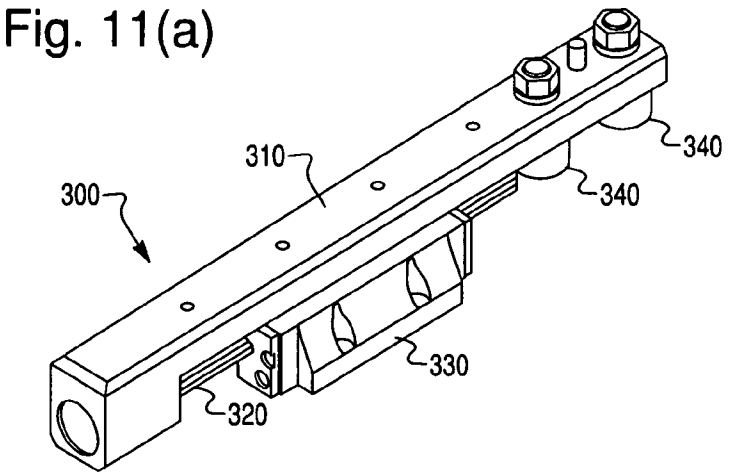
Figure 11C:
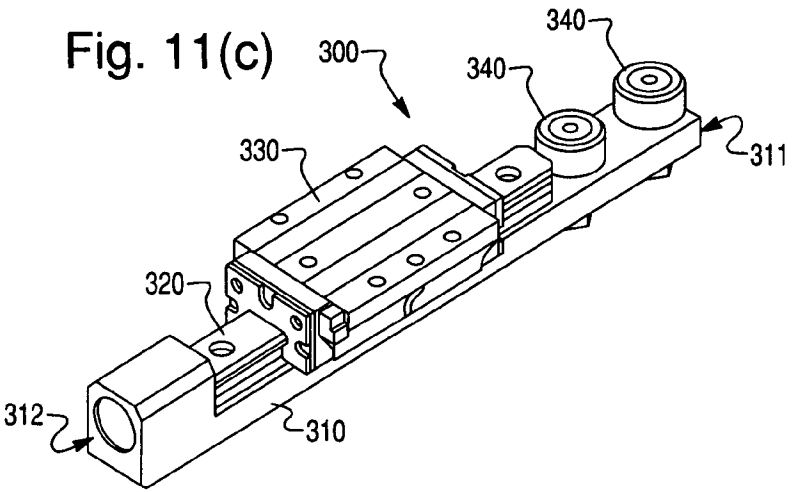

FIGS. 10(*a*), 10(*b*) and 10(*c*) illustrate a can 205 before and after expansion. FIG. 10(*a*) illustrates a can 205 prior to expansion. The neck 205N of the can 205 has approximately an equal or constant diameter. The can 205 is shown in FIG. 10(*a*) in the state prior to being transferred from the first transfer star wheel 202 to the expansion (forming) turret 210. In FIG. 10(*b*), the can 205 has undergone an expansion operation and has one expanded section 247. The expansion operation thus provides an expanded or enlarged open end of the neck 205N of the can 205. In FIG. 10(*b*), the expansion tool 240 has already been inserted into and removed from the neck 250N of the can 205 to form the expanded section 247. FIG. 10(*c*) illustrates the can 205 following the first expansion operation and a necking operation. The necking operation lengthens and/or narrows the neck 205N of the can 205, which can create a "bump" (protruding section) out of the expanded sections 247. The necking operation is not required, but is shown for exemplary purposes.

In an alternative embodiment shown in FIGS. 10(*d*) and 10(*e*), the can 205 may have two expanded sections 247 from two separate expansion operations. For example, the can 205 may be passed from two separate forming turrets 210 that each perform an expansion operation on the can 205. FIG. 10(*d*) illustrates the can 205 immediately following a second expansion operation, which occurred after the first expansion operation and a necking operation. FIG. 10(*e*) illustrates the can 205 after an additional necking operation is performed following the second expansion operation, thus creating two "bumps" or expanded sections 247 in the neck 205N of the can 205.

It will be recognized that the can 205 may have one, two, three or more expanded sections 247 (or "bumps") of equal or different diameter and may undergo any suitable number of necking operations before, in between and after expansion operations.

In an embodiment, the expansion tool 240 is actuated by a linear slide assembly with a cam and cam follower, such as shown in FIGS. 11(*a*) to 11(*d*). The linear slide assembly 300 comprises a slide block 330 containing rolling elements (such as ball bearings, not shown) and a profiled rail 320, which slides in the slide block 330. According to an embodiment, the slide block 330 is fixed and the profiled rail 320 is capable of moving in a linear manner. This mounting gives us a more compact design for the entire ram assembly 300 while maintaining the load at the center of the rolling elements. The mounting may also reduce the mass of the moving components. The rail 320 is "profiled" due to its shape. The rail 320 has been cut or formed into the outline (profile) shown in FIGS. 11(*a*) to 11(*d*) and, thus, is a profiled rail. Alternatively, the rail 320 may be cut or formed into any other suitable shape (profile).

In addition to the slide block 330 and profiled rail 320, the assembly 300 includes an adaptor 310 mounted to the profiled rail 320. On one end 311 of the adaptor 310 there are provisions for mounting cam followers 340. On the other end 312 of the adaptor 310 there are provisions for mounting a base plate 234 (such as described above), the stop plate 220 to move the can 205 into alignment with the expansion tool 240, or any other appropriate tooling.

The cam followers 340 follow a cam (not shown) positioned on a cam support 375 on a shaft. The structure of the assembly 300 allows for approximately a four inch or more stroke while maintaining a rigid (inflexible) support at the end 312 of the adaptor and/or profiled rail 320.

Figure 12:
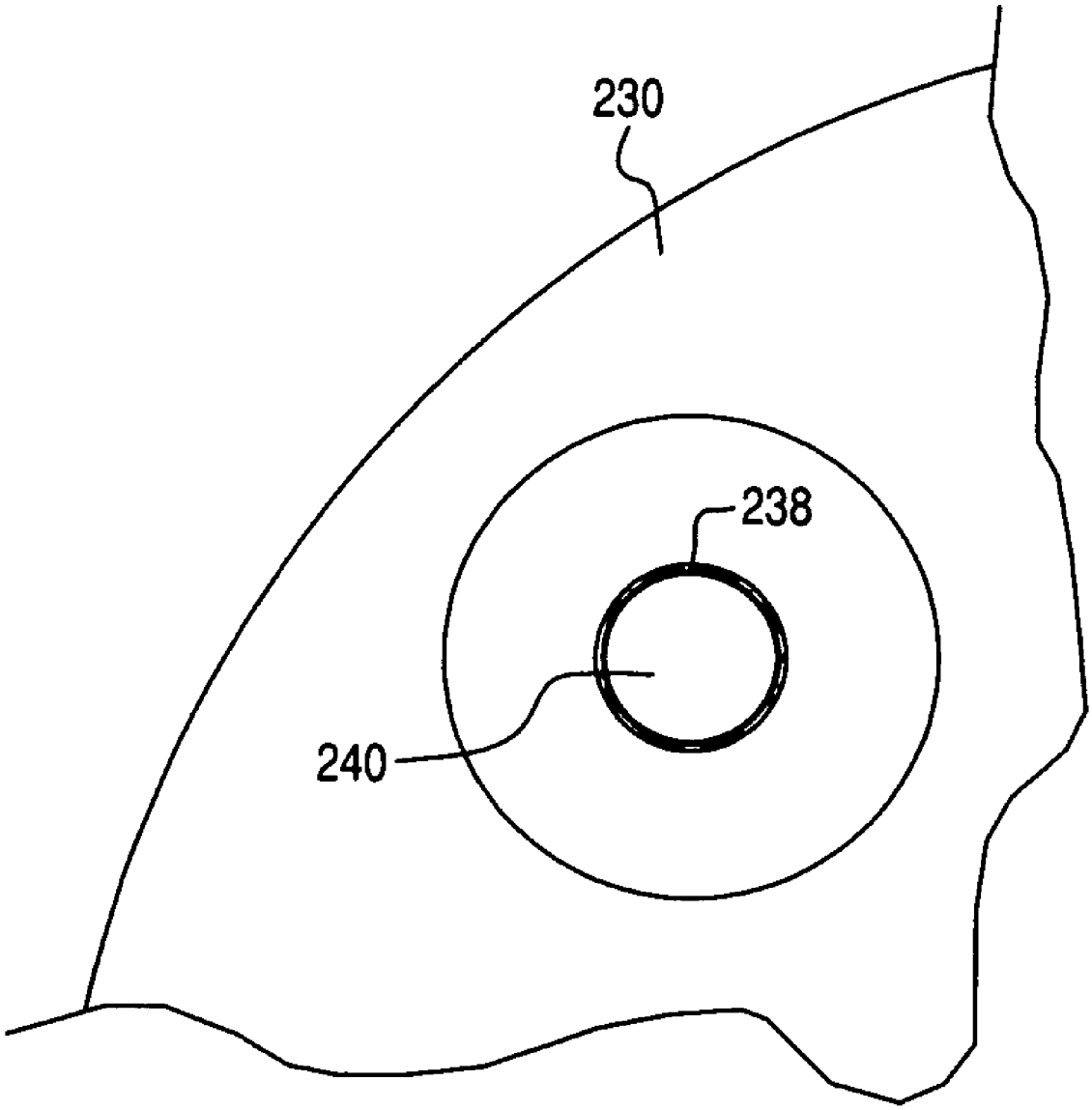
FIG. 12 is a front view of a stripping plate according to another embodiment.

The stripping plate 234, according to an embodiment, also includes a retaining ring 238 configured to receive the open end of the can 205 (as shown in FIG. 12). An end of the can 205 may rest against the ring 238. It will be recognized that the ring 238 may be of any suitable size and/or depth. The retaining ring 238 may be made of metal or any other suitable material and may be integral with or an added component of the stripping plate 234. Alternatively, a portion (approximately ⅛ inch) of the can 205 may slide into the ring 238 during the expansion operation such that the retaining ring 238 may just be an opening in the stripping plate 234.

It will be recognized that the can expansion mechanism may utilize any other suitable ram assembly.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. An apparatus to expand a diameter of an open end of an article, comprising:

a forming turret that includes:

a forming tooling; and a stop plate, the stop plate configured to be adjacent a closed end of an article to restrict motion of the article, the stop plate being axially movable relative to a turret axis of rotation, wherein the forming tooling includes an expansion tool axially movable relative to the turret axis of rotation and a stripping plate, wherein the stripping plate includes an opening through which the expansion tool passes, the expansion tool being configured to move into an open end of the article to expand the diameter of the article, the expansion tool comprising a single tool configured to move into the open end of the article to expand the inner diameter of the article, and wherein only the single tool is configured to move into the open end of the article during an expansion operation, wherein the single expansion tool moves into a central portion of the open end of the article and the single expansion tool includes a forming diameter portion that contacts a substantially entire interior diameter of the open end of the article at one time.

2. The apparatus according to claim 1, wherein the forming turret is configured to continuously rotate when the forming tooling is processing an article.

3. The apparatus according to claim 1, wherein the expansion tool includes a lead in portion, a pilot portion and the forming diameter portion.

4. The apparatus according to claim 3, wherein the forming diameter portion defines a diameter to which the article is expanded.

5. The apparatus according to claim 3, wherein a diameter of the pilot portion is approximately equal to an initial diameter of the article prior to expansion.

6. The apparatus according to claim 1, wherein the stripping plate is configured to remove the article from the expansion tool if the expansion tool does not completely withdraw from the article after the expansion operation.

7. The apparatus according to claim 1, wherein the stripping plate is fixed and immovable.

8. An apparatus to expand a diameter of an open end of an article, comprising:

a forming turret that includes:

forming means; and stopping means to restrict motion of the article, wherein the forming means includes expansion means to expand a diameter of the article, and a stripping plate with an opening, the expansion means including an expansion tool comprising a single tool configured to move into the open end of the article to expand the inner diameter of the article, wherein only the single tool is configured to move into the open end of the article during an expansion operation, wherein the single expansion tool moves into a central portion of the open end of the article and the single expansion tool includes a forming diameter means that contacts a substantially entire interior diameter of the open end of the article at one time.

9. The apparatus according to claim 8, wherein the forming turret is configured to continuously rotate when the forming means is processing an article.

10. The apparatus according to claim 8, wherein the expansion means includes a lead in means, a pilot means and the forming diameter means.

11. The apparatus according to claim 10, wherein the forming diameter means defines a diameter to which the article is expanded.

12. The apparatus according to claim 8, wherein the stripping plate is configured to remove the article from the expansion tool if the expansion tool does not completely withdraw from the article after the expansion operation.

13. The apparatus according to claim 8, wherein the stripping plate is fixed and immovable.

* * * * *